US008002114B2

(12) United States Patent
Faber

(10) Patent No.: US 8,002,114 B2
(45) Date of Patent: Aug. 23, 2011

(54) METHOD OF PREPARING THE FINAL ASSEMBLY OF STAMPS AND STAMP PACKAGE

(75) Inventor: Ernst Faber, Wels (AT)

(73) Assignee: Colop Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

(21) Appl. No.: 12/655,676

(22) Filed: Jan. 5, 2010

(65) Prior Publication Data

US 2010/0170813 A1 Jul. 8, 2010

(30) Foreign Application Priority Data

Jan. 8, 2009 (AT) ..... A 25/2009

(51) Int. Cl.
*B65D 65/00* (2006.01)
*B65D 71/08* (2006.01)

(52) U.S. Cl. ..... 206/497; 206/216; 206/747; 53/467

(58) Field of Classification Search ..... 206/216, 206/497, 576, 542, 227, 239, 238, 747, 749, 206/750, 232; 101/348, 349.1, 104; 53/467
See application file for complete search history.

(56) References Cited

U.S. PATENT DOCUMENTS

| | | | | |
|---|---|---|---|---|
| 3,917,056 | A * | 11/1975 | Taub | 206/750 |
| 4,715,497 | A * | 12/1987 | Focke et al. | 206/254 |
| 6,110,092 | A * | 8/2000 | Focke et al. | 493/375 |
| 6,994,025 | B1 | 2/2006 | Faber | |
| 7,370,761 | B2 * | 5/2008 | Andersen et al. | 206/497 |
| 2001/0001447 | A1 * | 5/2001 | Gregory | 206/746 |
| 2007/0012206 | A1 * | 1/2007 | Pointl | 101/334 |
| 2007/0272099 | A1 * | 11/2007 | Pointl | 101/104 |
| 2008/0230420 | A1 * | 9/2008 | Cerveny et al. | 206/432 |

FOREIGN PATENT DOCUMENTS

| | | |
|---|---|---|
| AT | 380 836 | 7/1986 |
| JP | 49-124113 | 10/1974 |
| JP | 51-101810 | 8/1976 |
| JP | 59-109383 | 6/1984 |
| WO | WO 00/48843 | 8/2000 |
| WO | WO 2005/084953 | 9/2005 |

* cited by examiner

*Primary Examiner* — Mickey Yu
*Assistant Examiner* — Rafael Ortiz
(74) *Attorney, Agent, or Firm* — Collard & Roe, P.C.

(57) ABSTRACT

In order to prepare the final assembly of stamps which have a rest position, in which a stamp housing projects from an actuating yoke, and an operating position, in which the actuating yoke is moved against the force of a spring over the stamp housing and is lockable, as well as for the final assembly of the stamps by applying a stamp plate to a plate holder, several stamps are packed in a carton-like package (20) in at least one row in parallel to each other; the packaging (20) is closed with a covering (26) and the stamps are held in this way in the closed position; after opening of the packaging (20) prepared text plates (6) are adhered to plate holders (5) of the stamps (1).

18 Claims, 10 Drawing Sheets

METHOD OF PREPARING THE FINAL ASSEMBLY OF STAMPS AND STAMP PACKAGE

CROSS REFERENCE TO RELATED APPLICATIONS

Applicant claims priority under 35 U.S.C. §119 of Austrian Application No. A 25/2009 filed on Jan. 8, 2009.

FIELD OF INVENTION

The invention relates to a method of preparing the final assembly of stamps as well as, preferably, of finally assembling the stamps through the application of a stamp plate to a plate holder, whereby the stamps have a rest position, in which a stamp housing projects from an actuating yoke, and an operating position in which the actuating yoke is moved against the force of a spring over the stamp housing and is lockable, whereby in said method, before final assembly, the stamps are packed in a carton-like package and are removed from the package during final assembly, whereby prepared text plates are adhered to plate holders on the stamps.

The invention also relates to a stamp package with a carton body which can be used with a method of this type.

BACKGROUND OF INVENTION

Stamps, more particularly self-inking stamps, as indicated above, that is with a stamp housing and an actuating yoke moved over it against the force of a spring, said actuating yoke coupled with a stamp plate plate holder to move it forwards in order to produce stamp markings are known, for example, from US 2007-0012206, WO 2005/084953 A2, WO 00/48843 and AT 380 836 B. As a rule these are self-inking stamps with a turning mechanism, with an ink pad holder in the stamp housing as well as a stamp plate, which is attached to a plate holder and with the aid of the turning mechanism is moved from a upper inking position, in which the stamp plate is in contact with the stamp pad into a lower printing position. To bring about this movement the actuating yoke is pushed downwards relative to the stamp housing placed on the substrate to be printed. In this pressed-down operating position or stamping position the actuating yoke usually can also be locked with the aid of a catch or suchlike to the stamp housing.

In the case of these stamps it is usual to pack each stamp individually in its own packaging carton in the released rest position in which the actuating yoke is moved back, upwards relative to the stamp housing. However, packing several stamps, i.e. stamps without a self-inking device, in rows in an open box is also known, whereby the stamps are of fixed dimensions as they only have a grip with stamp types attached thereto; c.f. JP 51-101810 U, JP 59-109383 A and JP 49-124113 U.

Furthermore, with the stamps involved here the stamp plates are only mounted later, i.e. at a stamp-maker's, who acquires the stamps in a single pack of this type and adheres the stamp plates on the plates holders for customers. For this purpose the stamp must be removed from the single box, the stamp pressed together and the catch actuated in order to lock the stamp in the operating position. Thereafter, a protective film must be removed from the plate holder, this film having until this time protected the adhesive layer on the plate holder. Thereupon the required text plate is adhered to the plate holder. The stamp can then be unlocked, and a sample may be stamped on a prefabricated stamping card, whereby after removal of a viewing panel on the actuating yoke this stamping card is attached to the latter.

For delivery of the stamps with the mounted text plates to the end customer, the stamp is repacked into the single carton after these procedures.

This process is laborious and time-consuming. Apart from this the packing costs are high, as not only are the stamps packed individually into cartons, but the stamps also have to be packed in the expanded rest position, in which they are approximately 30% greater in height than in the locked operating position.

SUMMARY OF THE INVENTION

The aim of the invention is to remedy this situation and propose a simple, more efficient method and/or form of packing for stamps, in which, more particularly, a larger number of stamps can be simply prepared for dispatch and also made available for final assembly, and in which savings can be made in the packing volume required for transportation.

To attain this objective the invention envisages a method and a stamp package as set out below together with advantageous embodiments and further developments.

In accordance with a preferred method according to the invention, several stamps are placed in at least one row, preferably in two rows, the rows being in parallel to each other, in a carton-like package, in a carton body, the upper side of which is open. The stamps are packed in their locked operating position in which they take up a smaller volume than in the expanded rest position, and are kept in the package in this locked operating position. This can be done, for example, directly by the cover on the pack and/or the carton body, but preferably the stamps are arranged in two (or more) rows in the packaging in such a way that the stamps in one row are arranged the other way round to the stamps in an opposing row, whereby the stamps face each other or are in contact with each other with their plate holders. In this way, the stamps in the opposite rows keep each other in their locked or blocked position, with the covering keeping the stamps from moving out of the package. Apart from this, particularly if the covering of the package is hermetically sealed, it is not necessary to apply the usual protective films to the plate holders. In the present packaging the stamps can be stored protected from dust because of the covering, and the adhesive films on the plate holder thereby remain clean and adhesive. However, if necessary, a separating film, e.g. a silicone film, can be inserted between the opposing rows of stamps for protection. This depends on the type of pressure adhesive the adhesive films on the plate holders are made of. Nonetheless, if unintentional sticking of the opposing rows of plate holders to each other is not to be feared such a separating film can be dispensed with. As the yokes are placed together with their sides or legs, they protect each other against unintentional unlocking so that the stamps remain securely in their locked position as long as they are stored in the package. If there is only one row of stamps,the packaging cardboard, namely the carton body, or the covering, must be sufficiently stable to secure the yokes against unintentional unlocking.

Tests have shown that in all cases, simply a film, preferably a shrink film, can be applied as a covering to seal the pack. Accordingly, envisaged as the actual package is a carton-body which is open at the top, over which such a film, preferably a shrink film, is applied, this film being attached to the sides or the bottom of the package, such as through adhering or hot sealing.

When the stamp or text plates are to be applied to the stamps, for final assembly the covering is opened in one plane, essentially the plane of the plate holders of the stamps arranged in rows, in order to expose the plate holders, whereupon the text plates are adhered to the plate holders which are still located in the opened package. As the stamps are still present in the package, but the plate holders are exposed, the text plates can simply be applied and adhered one after the other on the plate holders of the packed stamps.

In the case of packages of stamps with opposing rows of stamps it is particularly advantageous if for final assembly the covering is essentially separated along a line corresponding to the boundary between the opposing plate holders, after which the thus obtained pack sections, each with, for example, one row of stamps, can be folded apart, whereupon the stamps are present with the plate holders in the exposed position, after which the text plates can be adhered to the plate holders which are still located in the opened package.

The covering can be cut open, e.g. along a printed line, for example with a knife; if opening with a knife is to be dispensed with, in the case of film covering, a tear-open thread can be provided in the film covering. It is also conceivable to apply a tear-open tab in the covering, whereby in this case the covering can also consist of, for instance, cardboard which has a tear-open tab strip over its entire central length, in a similar way to that known with other packages, for instance foodstuff packages.

In order to make the plate holders accessible for adhering the text plates, if stamps are packed in two or more rows, additional advantageous measures can be envisaged to facilitate folding open the two halves of the carton-like package. Thus, it is particularly beneficial if a central folding line is provided on the base of the carton body which corresponds to the boundary between the plate holders of the stamps, so that the carton-like package can be folded open about this folding line after removal or opening of the covering. The folding line can be formed by a weakening line or provided as a perforated line, or from the very beginning two carton body halves can be connected to each other by means of a strip of film in the form of a film hinge.

The side walls of the box body can extend up to the top of the stamps packed therein or to slightly below the top in order to facilitate access to the stamps at the edge after opening the package. The carton body can consist of simple cardboard, though plastic can also be considered as material for the carton body.

As stated, for the final assembly of the stamps in a package, where it is assumed that two rows of stamps are packed, the covering, preferably a film, is simply separated in the middle and the two package sections are folded apart about an angle of 90°. The stamps, which are in their locked operating position, are then facing upwards with their plate holders and the relevant stamp and/or text plate can now be adhered directly onto the respective plate holder. It is of great advantage here that in this assembly process it is possible to proceed much more efficiently and quickly than before, above all as a larger number of stamps can undergo final assembly in one go, whereby in particular, the removal of individual protective films from the plate holders—which in accordance with the prior art is especially time-consuming due to the poor accessibility—can be dispensed with.

After adherence of the text plates, the stamps can be removed from the package, they are then unlocked and a sample stamp can be produced, for example on the stamping card provided in the package. The viewing windows are then removed from the actuating yokes and the stamp cards fitted, whereupon the viewing windows again are placed in their positions.

With the aid of the present packaging technique, a considerable amount of packaging material can also be saved. More particularly, it is possible to re-use the carton bodies. Above all it is important that in the case of the present packaging technique, the stamps take up approximately 30% less volume, which also helps to save overall transportation volume.

BRIEF DESCRIPTION OF THE DRAWINGS

The invention will be further explained below with the aid of preferred examples of embodiment, to which it is not, however, restricted, and with reference to the drawings. In more detail, in the drawings:

FIG. 3, in partial

DETAILED DESCRIPTION OF THE DRAWINGS

Figure 1:
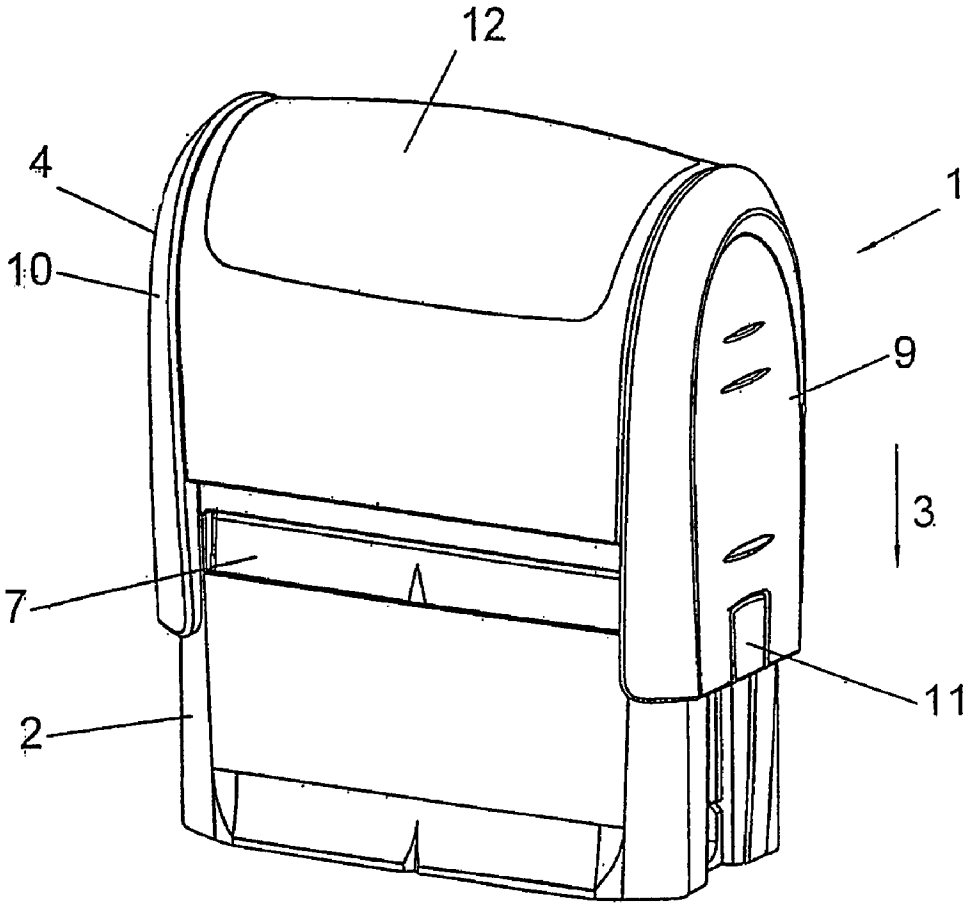
FIG. 1 (Prior Art)
FIG. 1 shows a axonometric view of a (self-inking) stamp, known per se, in its rest position, in which an upper actuating yoke is in an upper position relative to a lower stamp housing.
Figure 2:
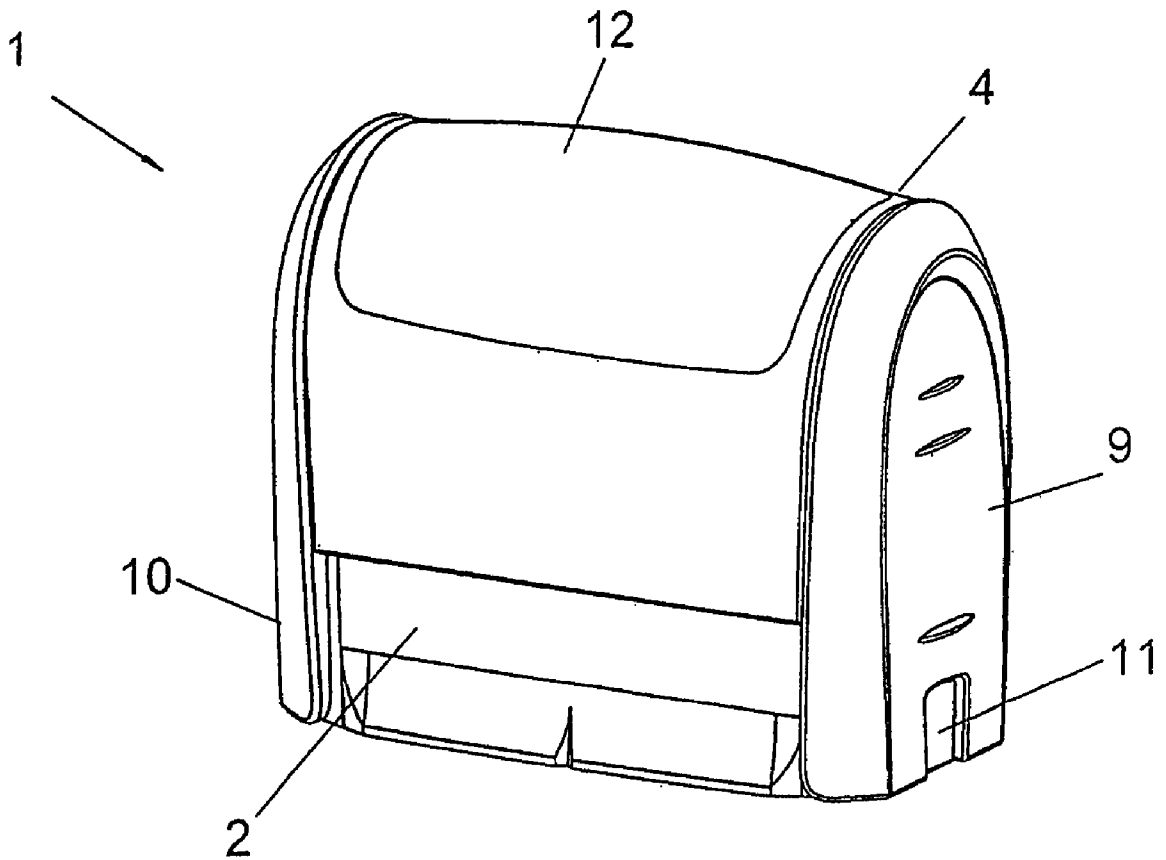
FIG. 2 (Prior Art)
FIG. 2 shows a corresponding axonometric view of such a stamp in the locked operating position in which the actuating yoke has been moved downwards relative to the stamp housing.
Figure 3A:
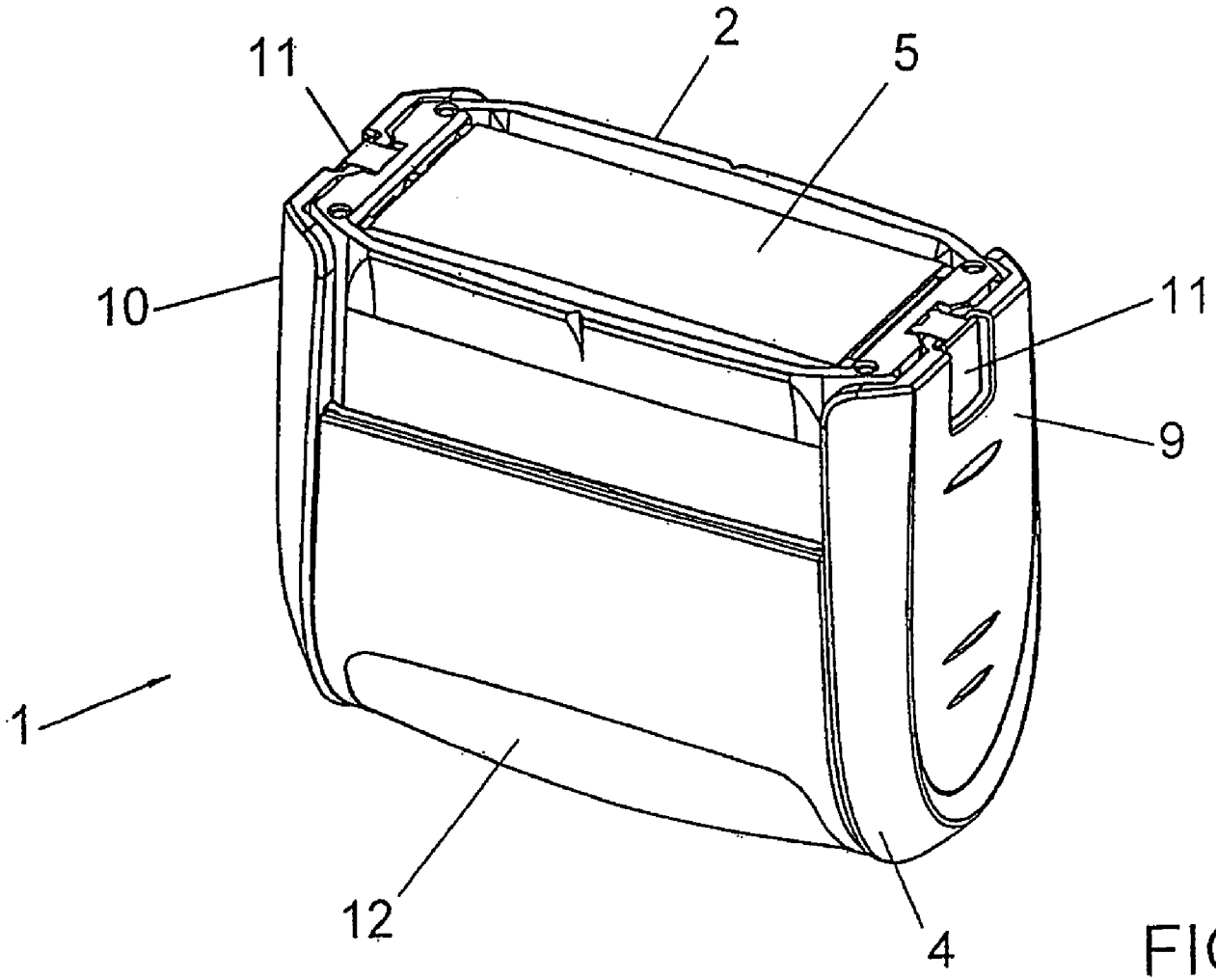
FIG. 3A (Prior Art)
FIGS. 3A and 3B, shows a diagrammatic view of the stamp according to FIGS. 1 and 2, with the underside turned upwards, where in FIG. 3A the stamp is shown without an affixed stamp and/or text plate and in FIG. 3B with a stamp and/or text plate.
Figure 3B:
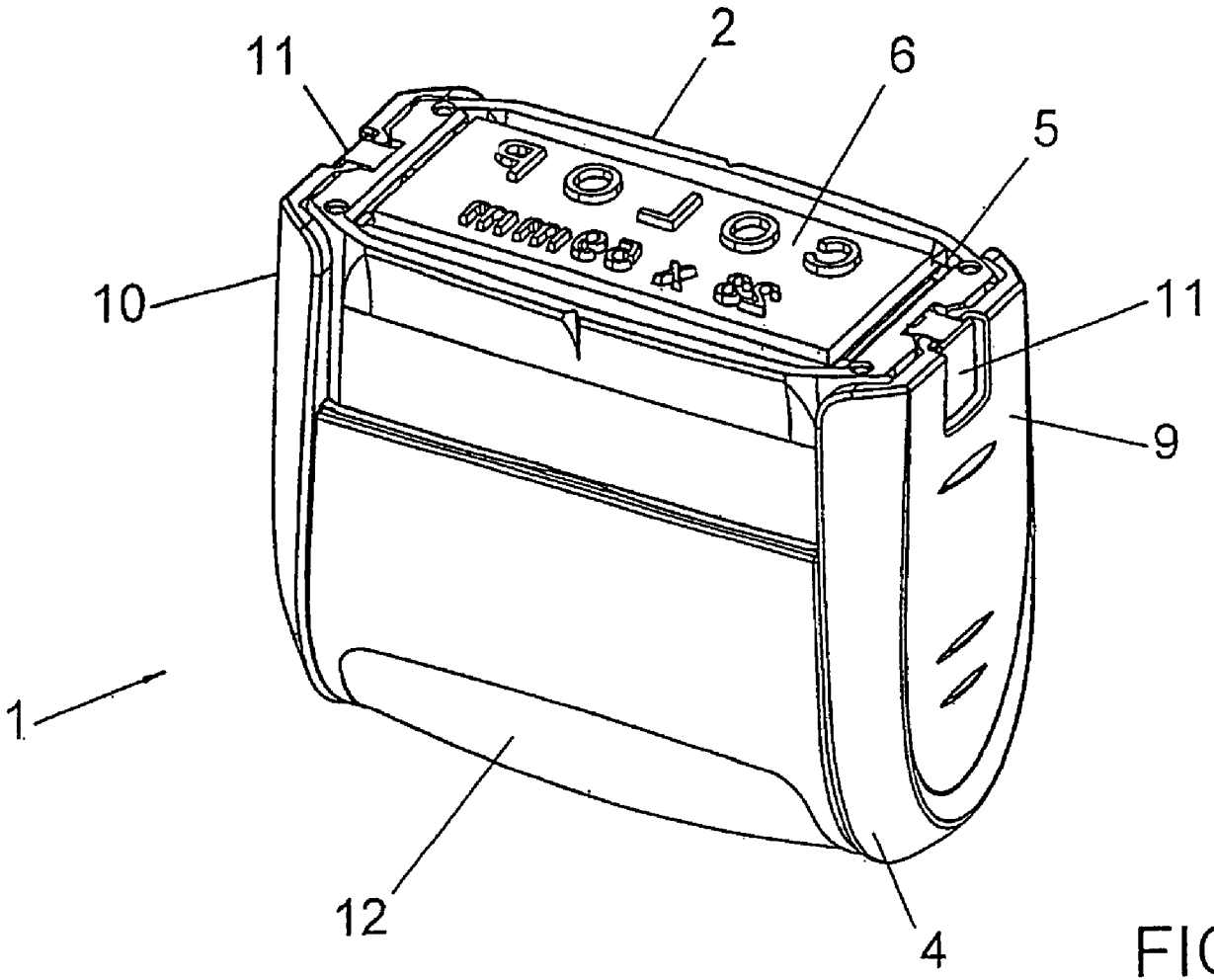
FIG. 3B (Prior Art)

In FIGS. 1 to 3 a conventional self-inking stamp 1 is shown, which, in accordance with the representation in FIG. 1, has an actuating yoke 4 which is pushed over a stamp housing 2 in the direction of an arrow 3 if a stamp impression is to be produced on a substrate, which is not shown in more detail. On the inside of the stamp housing 2, which is open at its lower side, there is a stamp plate plate holder 5, on which on the finished stamp (see FIG. 3B) a stamp or text plate, hereinafter referred to in brief as text plate, is adhered, In the rest position shown in FIG. 1 a stamp pad 7 inserted into a horizontal shaft can be seen, on which on the underside in the shown rest position the plate holder 5 with the text plate 6 is in contact for inking. From this position with the text plate 6 facing upwards, the plate holder 5 and text plate 6 are, on pushing down (direction 3) of the actuating yoke 4, moved about 180° with the aid of a known turning mechanism, not shown in more detail, and downwards so that after inking the downward facing text plate 6 can produce the required stamp print on the substrate. On the side of the actuating yoke 4, on at least one of the two yoke arms or legs 9, 10, there is a catch 11 which interacts with recesses (which are not shown), in the stamp housing 2 in a conventional manner in order to fix the stamp 1 in, for example, the rest position in accordance with FIG. 1 and the locked position in accordance with FIGS. 2 and 3.

The actuating yoke 4 also has an upper viewing pane or window 12, which is at least partially transparent, and under which a stamp card serving as a sample of the stamp can be inserted.

In FIG. 3A the stamp in the locked operating position is shown rotated about 180° still without a text plate 6, and in this position the text plate 6 can be adhered by pressing it on the plate holder 5 which is provided with a corresponding adhesive layer, more particularly a pressure adhesive, so that the finally assembled stamp 1 in accordance with FIG. 3B is obtained. Adhering the text plate 6 is frequently not carried out at the manufacturer's but at a stamp-maker's or an intermediate dealer's, and it is an aim of the present invention to make this final assembly as easy as possible with a large number of stamps 1 in one consignment.

Figure 4:
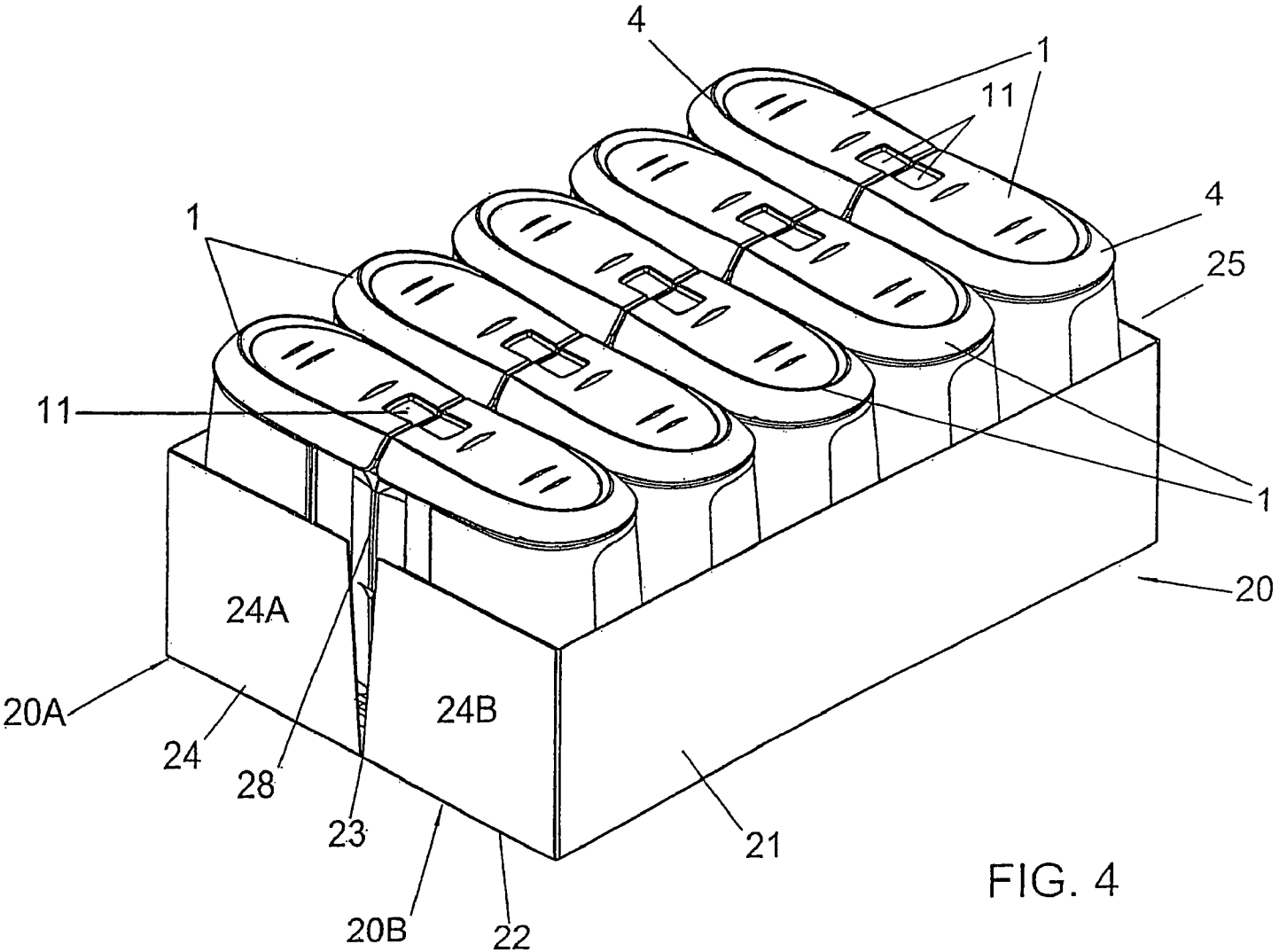
FIG. 4 shows a prepared package, not yet with a cover, for 2×5 stamps in accordance with FIGS. 1 to 3.
Figure 5:
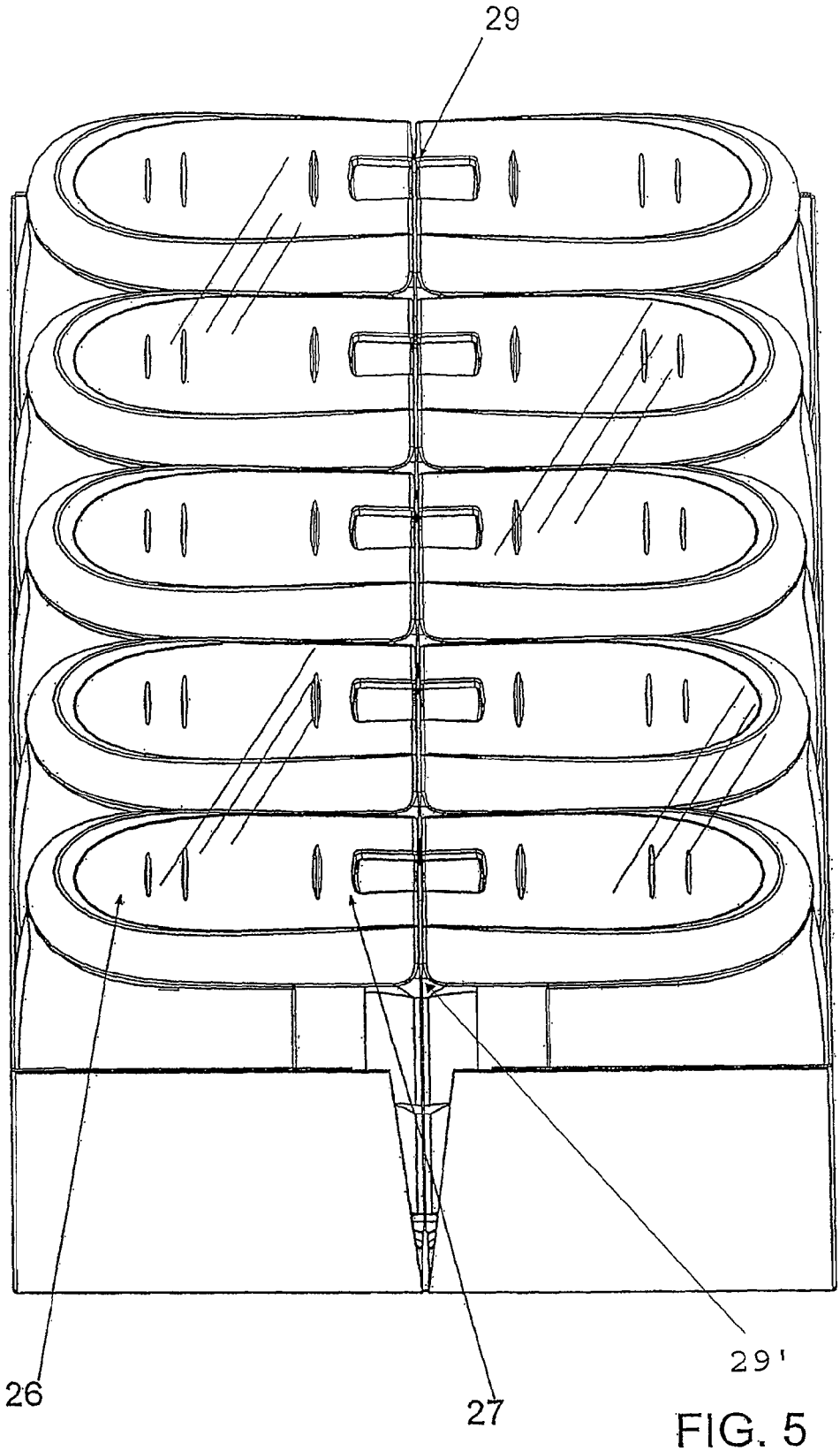
FIG. 5 shows this package according to FIG. 4 with an additionally applied film cover.
Figure 6:
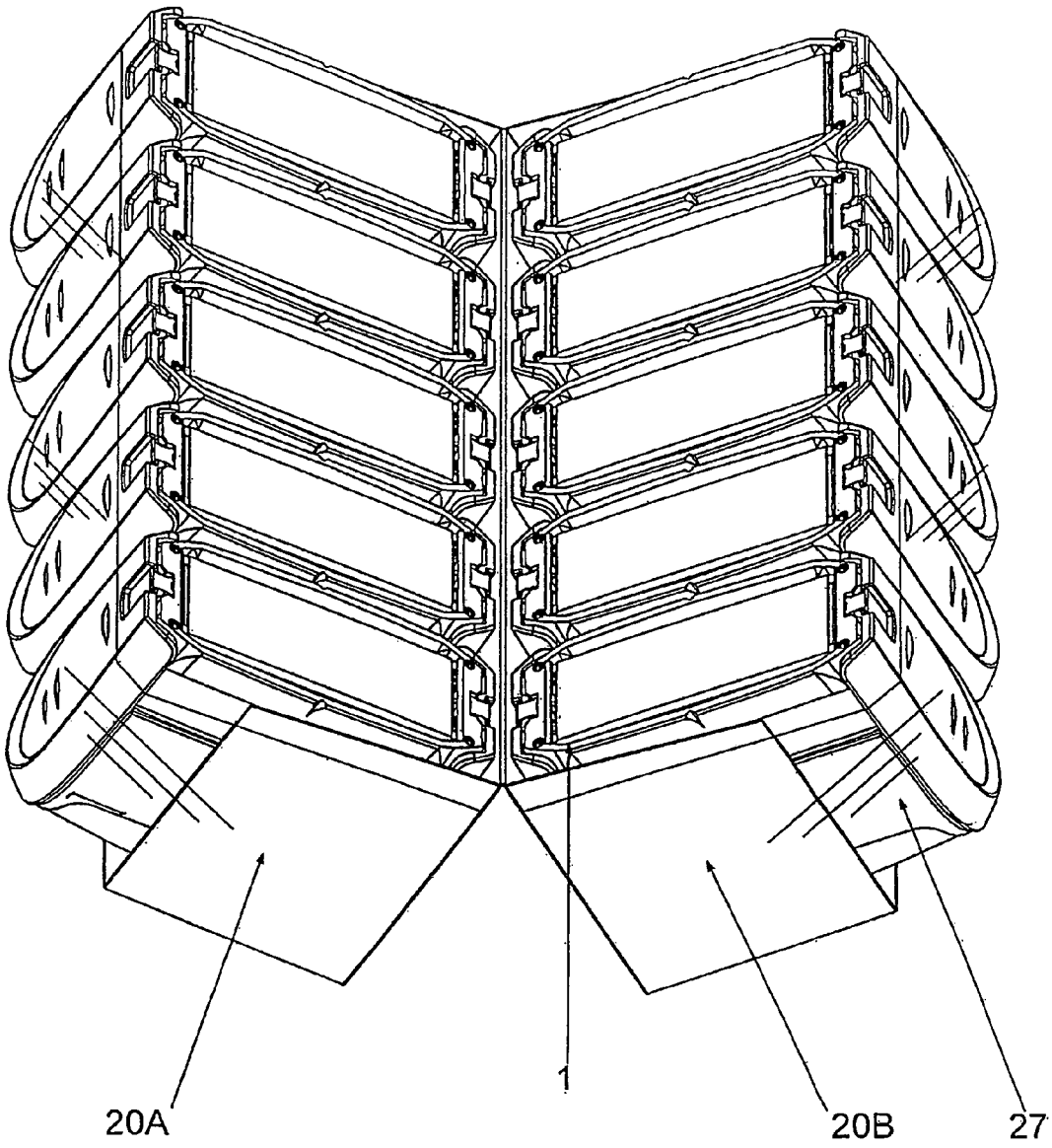
FIG. 6 shows a view of this package in accordance with FIGS. 4 and 5 with a cut open film cover and partially open-folded package sections.
Figure 7:
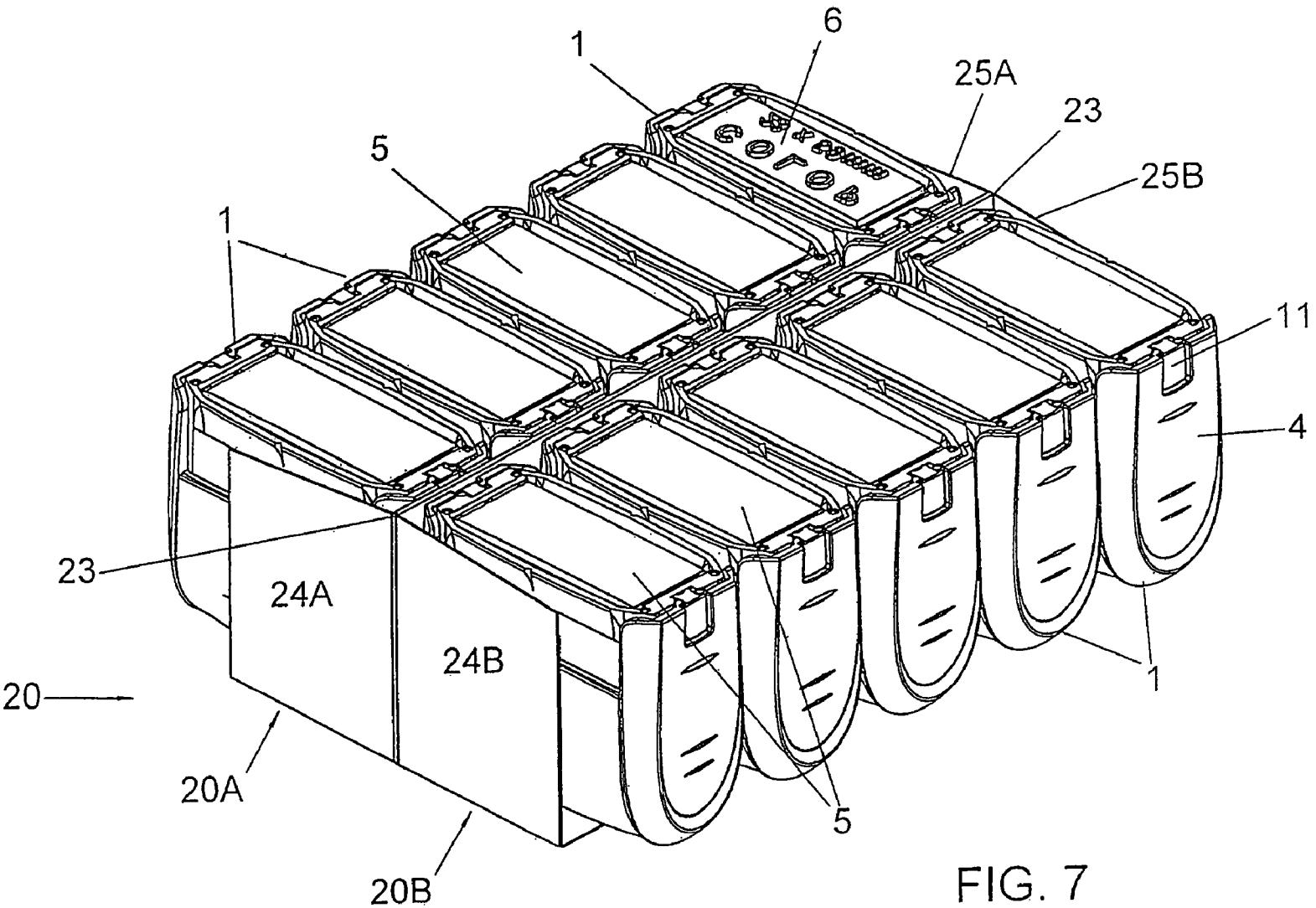
FIG. 7 shows a diagrammatic view of this package with fully folded out package sections and without film, whereby a text plate is shown on one of the stamps with the plate holders facing upwards.

In accordance with FIG. 4, several, e.g. 2×5, such stamps 1 are accommodated in an upright position, with plate holders 5 (see FIG. 3A) facing each other, in a carton-like package 20 with a carton body 21 but without a cover. On its base the carton body 21 has a folding line 23 which extends centrally from the front end face 24 over the entire length of the carton body 21 to the rear end face 25 (in FIG. 4 only the front end of the folding line 23 can be seen). The carton body 21 can be made of cardboard, for example, and the folding line 23 is then formed by a weakened or perforated line. The front end face 24 is centrally divided so that two wall halves 24A, 24B are created, and the same applies to the rear wall 25, even though this cannot be seen in FIGS. 4 to 7. As a result of this design and the folding line 23 it is possible to fold apart the carton-like package 20, i.e. the carton body 21, centrally, whereby the folding axis is the folding line 23, as is shown in FIGS. 6 and 7, and as will be explained below in further detail.

In the arrangement shown in FIG. 4 with the stamps 1 in two rows, for example each row consisting of five stamps, the package 20 is closed, for example, by means of a covering 26 in the form of a film 27 (see FIG. 5), more particularly a shrink film. In this way the stamps 1 are enclosed in a dust-free manner in the package 20 for storage and transportation. As a result the adhesive surfaces on the plate holders 5 (see FIG. 3A) remain clean, and there is no need to apply a protective film on these plate holders 5, as was previously necessary when stamps in accordance with FIGS. 1 to 3 were packed individually in a folding box—in the rest position according to FIG. 1.

If necessary a separating film 28, such as a silicone film, can be inserted between the plate holders 5 of the two rows of stamps in order to prevent the plate holders 5 adhering to each other. Whether such a silicone film 28 is inserted as a separating layer also depends on how adhesive the adhesive surfaces of the plate holders 5 are if they come into contact with each other.

In the arrangement shown in FIG. 4 the stamps 1, inserted in their locked operating position (see FIG. 2) remain secured against unlocking in that the yokes 4, with their arms, rest against each other and mutually prevent unintentional unlocking. Therefore no springing open or sudden expansion due to the effects of springs that normally act between the stamp housing 2 and the actuating yoke 4 is to be feared when the package 20 is opened.

To open the package 20 the film cover 26 on the upper side of the package is opened along line 29 (see FIG. 5), which can be done, for example, by cutting open with a knife. A conventional tear-open thread 29' can also be incorporated in the film 27 in order to tear open the film 27 along line 29. After opening through cutting or tearing open the two sections of the package 20A, 20B can be folded apart along the folding line 23, as shown in FIG. 6. The stamps 1 in the two rows are each pivoted about 90° so that they are finally in a horizontal position with regard to each other with their plate holders 5 facing upwards, as shown in FIG. 7. The front wall halves 24A, 24B, and correspondingly the rear wall halves 25A, 25B have, in comparison with FIG. 4, taken up a position turned about 90° in the anticlockwise direction (24A) and in the clockwise direction (24B).

In this position of the opened package 20 the text plates 6 can be quickly and easily adhered to the plate holders 5. It is an advantage here that no protective films are necessary on the plate holders 5 which first have to be laboriously pulled off, as is the case in the prior art. In this way the stamps 1 can undergo final assembly through adhering the text plates 6 in relatively large numbers, which for large customers, who have to finally assemble a large number, e.g. hundreds of stamps 1, results in a considerable time saving.

A further advantage of the described package in accordance with FIGS. 4 to 7 is that a multiplicity of stamps 1 can be packed in the locked or blocked operating position in one joint package, whereby overall packaging volume can be saved. It has been shown that a volume saving of the order of 30% for storage and transportation is possible in this way.

Unnecessary packaging material can also be saved by using the present package 20.

The folding line 23 can theoretically also be an optional folding line in that the carton-like package 20 or carton bodies 21 are on folding apart of the two package sections 20A, 20B, separated or torn open along the line, or in that the two package sections 20A, 20B are only in contact with each other in the packaged position in accordance with FIG. 4. If necessary the two package sections 20A, 20B can also be connected to each other along their adjacent edges corresponding to line 23 with the aid of a strip-like adhesive film in the manner of a hinge. If the package sections 20A, 20B are made of plastic, the folding line 23 can also be formed by a plastic hinge.

Figure 8:
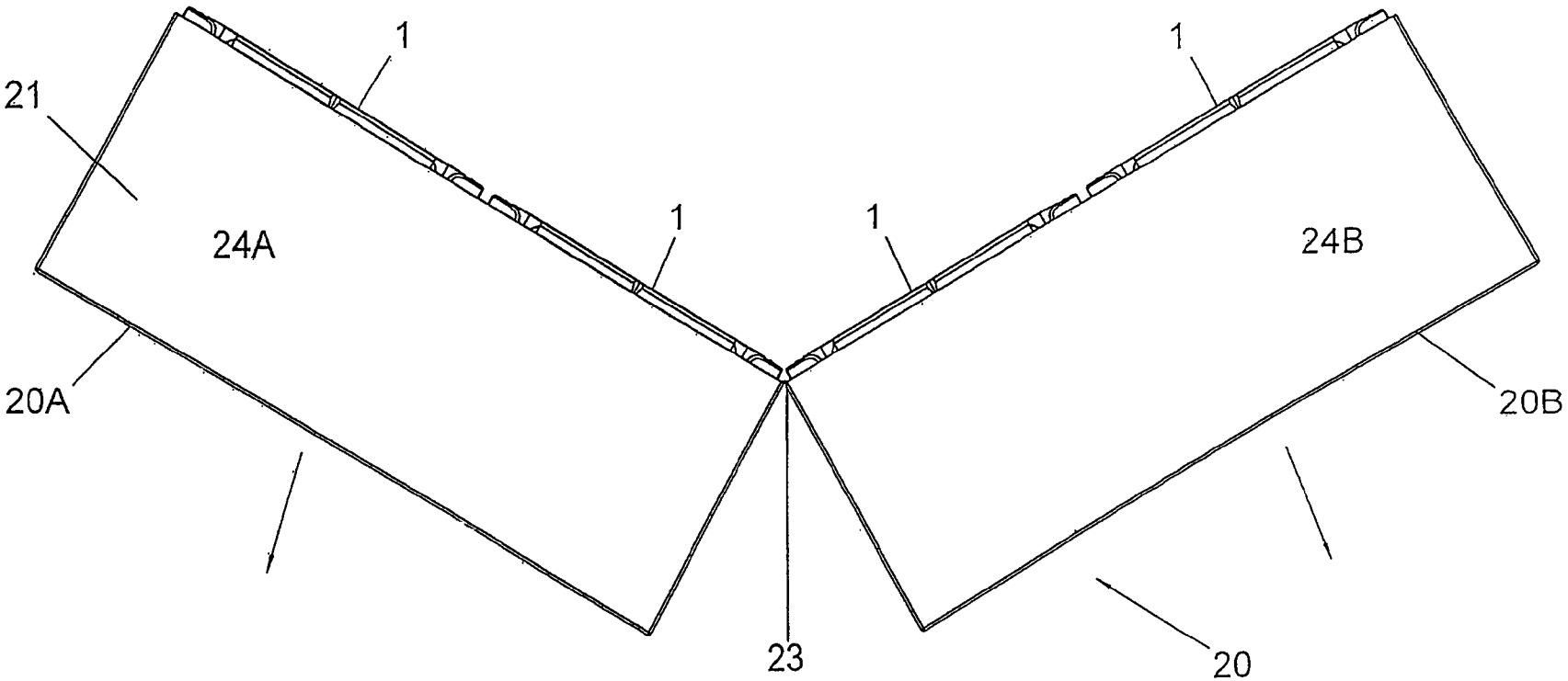
FIG. 8 shows a diagrammatic end view of a partially folded out package with 2×2 rows of stamps.

In FIG. 8 an half folded open package 20 is shown schematically, wherein each half, i.e. in each package section 20A, 20B, several, e.g. two, rows of stamps 1 are arranged. Here, too, the two package sections 20A, 20B are folded part along the folding line 23 in the direction of the arrows in order to finally take up a horizontally aligned position in accordance with FIG. 7, with the plate holders 5 of the stamps 1 facing upwards. The ends or parts 24A, 24B (and 25A, 25B; not shown in FIG. 8) of the carton body 21, are according to FIG. 8 double the width compared to FIGS. 4 to 7.

Figure 9:
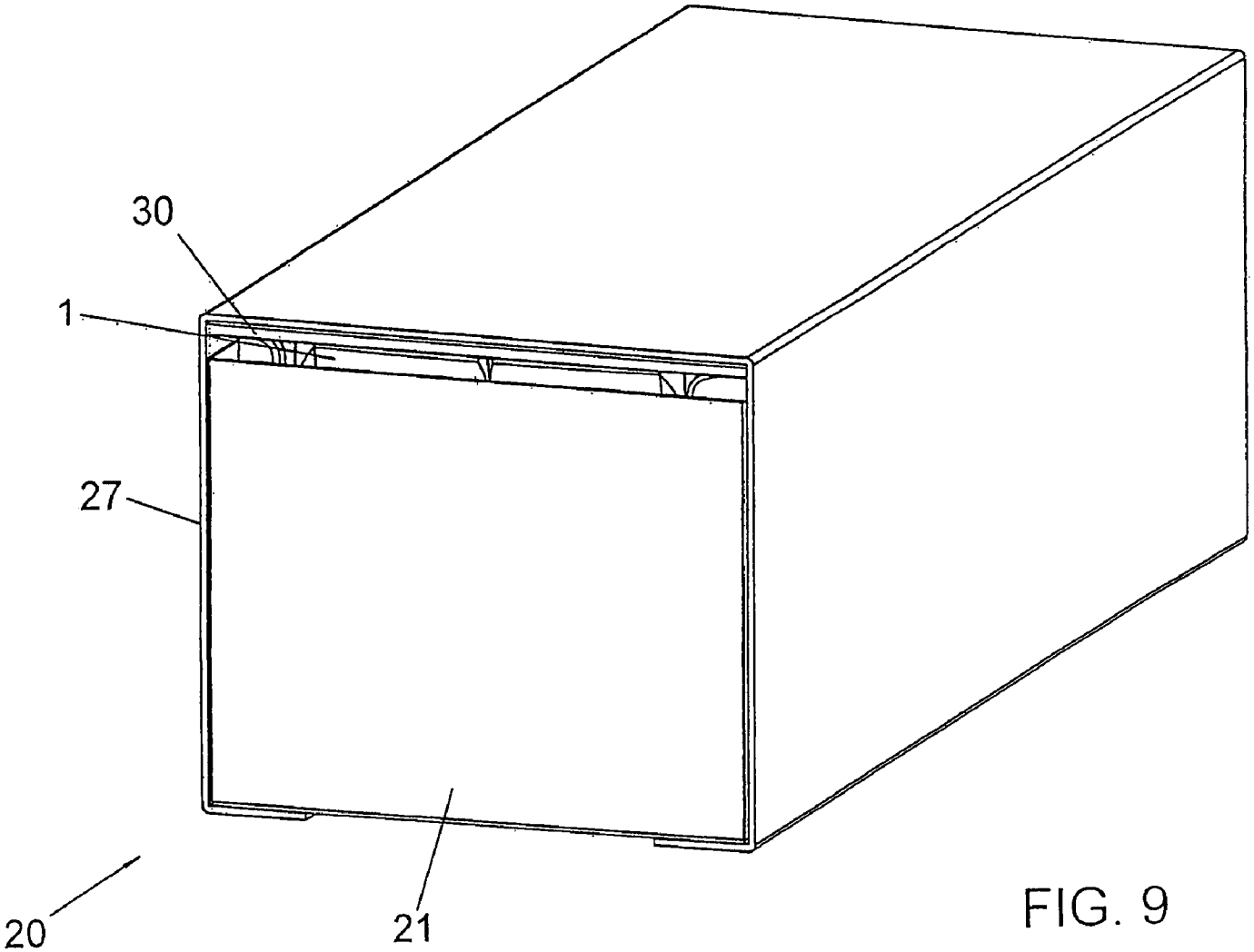
FIG. 9 shows a diagrammatic view of a package with a single row of stamp.

Finally, FIG. 9 schematically shows a simple package 20, whereby in a carton body 21 a, single row of stamps 1, in this case arranged in a carton body 21 with the plate holders 5 facing upwards, is envisaged. A film covering 27 is placed around the carton body 21 which keeps the stamps 1 in their locked operating position. If necessary a comparatively stiff strip of material 30 can be inserted between the stamps 1 and the film 27 extending over the row of stamps 1 and additionally securing the stamps 1 in their locked operating position. Here, central cutting open of the film 27 on the upper side of the package 20 is not envisaged, but pulling off of the film starting, for example, from the base of the package 20. In principle, however, opening of the film in the form of cutting or tearing open the film 27 on the upper side of the package 20 can also take place.

The invention claimed is:

1. A stamp package with a carton body which is open on one side and contains a plurality of stamps, each stamp comprising a stamp housing and an actuating yoke connected to a respective plate holder and movable relative to the stamp housing, and having a rest position in which each of the stamp housings projects from the actuating yoke, and a locked operating position in which the actuating yoke is moved over the stamp housing against the force of a spring and locked, wherein the stamps are packed in the package in two rows, wherein the stamps are present and held in the locked operating position in the carton body, with the respective plate holders opposite each other and in contact with each other, wherein a covering closing the carton body is provided and holds the stamps in the locked operating position in the carton body.

2. The stamp package of claim 1, wherein the covering is formed by a film.

3. The stamp package of claim 2, wherein the film is a shrink film.

4. The stamp package of claim 1, wherein the covering has a separating line corresponding to a plane defined by the rows of plate holders facing each other.

5. The stamp package of claim 4, wherein the separating line of the covering is designed with a tear-open thread.

6. The stamp package of claim 4, wherein the covering is formed by a film and the separating line is designed with a tear-open thread.

7. The stamp package of claim 4, wherein the separating line is designed with a tear-open tab.

8. The stamp package of claim 1, wherein the carton body has a base, and the base has a folding line corresponding to a plane between the plate holders.

9. The stamp package of claim 1, wherein the plate holders are arranged in pairs, and wherein a separating film is inserted between the plate holders arranged in pairs.

10. A method of preparing a final assembly of stamps, each stamp having a rest position in which a stamp housing projects out of an actuating yoke, and an operating position in which the actuating yoke, which is connected to a respective plate holder, is moved over the stamp housing against the force of a spring and is lockable in a locked operating position, said method comprising the steps of:

packing several stamps together in a carton-like package in at least two rows in parallel to each other, with the respective plate holders facing each other and adjacent to each other, in the locked operating position, before final assembly, and closing the package with a covering thereby holding the stamps in the locked operating position.

11. The method of claim 10, wherein a film is applied to the package, as said covering, in order to close the package.

12. The method of claim 11, wherein the film is a shrink film.

13. The method of claim 10, wherein, for final assembly, the covering is opened along a first plane which essentially corresponds with a plate holder plane defined by the plate holders of the rows of stamps, and the carton-like package is folded open along a folding line corresponding to a second plane defined by the plate holders arranged pair-wise of the rows of the stamps, in order to expose the plate holders, whereupon text plates are adhered to the plate holders still within the opened package.

14. The method of claim 10, wherein, for final assembly, the covering is opened essentially along a line corresponding to a plane defined by the plate holders arranged pair-wise of the rows of the stamps.

15. The method of claim 14, wherein the step of opening the covering is done with tearing with the aid of a tear-open thread.

16. The method of claim 10, wherein the plate holders face each other in pairs, and wherein a separating film is inserted between the plate holders facing each other in pairs.

17. The method of claim 10, wherein for final assembly, prepared stamp plates are adhered to the plate holders of the stamps.

18. The method of claim 10, further comprising the step of finally removing the stamps from the package.

* * * * *